United States Patent [19]

Pitrat et al.

[11] Patent Number: 4,684,770

[45] Date of Patent: Aug. 4, 1987

[54] MICROSWITCH

[75] Inventors: Alain Pitrat, Chateauneuf S/Isere; Bernard Truchet, Besayes, both of France

[73] Assignee: Crouzet, Paris, France

[21] Appl. No.: 756,255

[22] Filed: Jul. 18, 1985

[30] Foreign Application Priority Data

Jul. 23, 1984 [FR] France ..... 84 11766

[51] Int. Cl.[4] ..... H01H 5/24

[52] U.S. Cl. ..... 200/67 R

[58] Field of Search ..... 200/67 D, 67 DB, 67 A, 200/67 R

[56] References Cited

U.S. PATENT DOCUMENTS

| | | | |
|---|---|---|---|
| 3,098,903 | 7/1963 | Anderson | 200/67 A |
| 3,336,449 | 8/1967 | Ashman | 200/67 D |
| 4,130,747 | 12/1978 | Resh | 200/67 D |
| 4,551,592 | 11/1985 | Nishi et al. | 200/67 D |

FOREIGN PATENT DOCUMENTS

| | | |
|---|---|---|
| 902661 | 1/1954 | Fed. Rep. of Germany . |
| 2262995 | 7/1973 | Fed. Rep. of Germany . |
| 1248956 | 6/1960 | France . |
| 2116170 | 7/1972 | France . |
| 2237295 | 2/1975 | France . |

OTHER PUBLICATIONS

Design Engineering, No. 5, Mai 1978, pp. 55, 57, 59-61, New York, U.S.; D. N. Evans: "Electrical Contact Design-Cut Cost and Extended Life".

*Primary Examiner*—Stephen Marcus
*Assistant Examiner*—Renee S. Luebke
*Attorney, Agent, or Firm*—Stevens, Davis Miller & Mosher

[57] ABSTRACT

A microswitch comprises a compression spring abutting onto an insulating base which supports conducting terminals, the spring exerting indirectly a permanent tension force on flexible lateral arms of a blade pivotably mounted on one of the terminals with its free end being movable between the other terminals. The tension force is exerted via a pivoting point on an oscillating lever guiding an applied control force and sliding on the insulating base by one of its ends which is opposite another of its ends which pivotably mounts the lateral arms of the blade and which applies the tension force of the compression spring thereto.

1 Claim, 4 Drawing Figures

MICROSWITCH

BACKGROUND OF THE INVENTION

1. Field of the Invention

The present invention relates to an electromechanical switching device having a sensitive control of the abrupt positioning of a contactor element which is movable between fixed contact stops. More particularly, the invention relates to a switching device, comprising an insulating base in which are implanted three coplanar conducting terminals, an oscillating lever for guiding an applied control force and actuating the movable contactor element; and a conducting blade of composite structure formed as a single piece comprising: (1) a rigid axial arm mounted for pivoting on an end terminal of the device so as to form the movable contactor element, and (2) two flexible lateral arms fixed to the free end of the rigid axial arm and coupled beyond its pivoting point so as to form a stirrup on which a traction force of the oscillating lever is applied.

2. Description of the Prior Art

A switching device of the type just described is taught, for example, in U.S. Pat. No. 4,130,747.

This device, which is very widely used and for which a great variety of mechanisms have been proposed, allows the practically instantaneous change of position of a movable contactor element to be obtained between fixed contact stops from the relatively slow movement of a control member acting irreversibly on means for determining a resilient detent.

In such a device, the abrupt operation is caused by the elasticity of the conducting blade. In the case mentioned above of the prior art, the arms of the blade are prebent for this purpose. This is a solution which is not only delicate to put into effect but which further does not offer much flexibility.

The present invention aims at overcoming these disadvantages.

SUMMARY OF THE INVENTION

The present invention provides a device of the above defined type in which the insulating base has, on the internal surface supporting the switching mechanism, a median projection offering a front bearing face to a compression spring whose thrust axis is disposed in an orientation substantially parallel to the surface of the base supporting the mechanism and included in the plane of the terminals. In addition, the oscillating lever is formed to contain the compression spring in an internal longitudinal housing provided at one end thereof. The lever is able to slide on the insulating base at another end, opposite the one containing the compression, by means of legs passing on each side of the median projection of the base, the oscillating lever containing the detent of the compression spring.

With such a spring a better performing device is obtained, for it is easier to use a spring with given characteristics than to shape a blade, with the risk of increasing its fragility. Moreover, with the oscillating lever bearing slidingly on the base, this bearing point is pushed back advantageously during operation, so that the path of the contacts carried by the blade is the least curved possible and almost vertical, which relieves the compression spring.

In addition, when mass production of these very small sized microswitches is desired, it is difficult to obtain satisfactory and durable functional qualities without using manual assembly techniques which are very costly, for they involve employing a skilled and meticulous manufacturing staff qualified for rapidly handling very small and delicate parts. Prebending of the blades, in particular, is a constraint. The fact that the blade of the device of the invention may be stamped out flat is then also another advantage. But the invention goes still further.

In a preferred embodiment of the device of the invention, the insulating base, in which are implanted the coplanar conducting terminals supporting the mechanism, is obtained by molding a plastic material over a continuous bimetallic strip which is partially cut out during the different steps of the manufacturing process and precious metal fitted to the electric contact zones situated on the conducting terminals may be recovered from the superfluous parts produced by the cut out operation.

BRIEF DESCRIPTION OF THE DRAWINGS

The different features and advantages of the invention will be clear from the following detailed description of one embodiment with reference to the accompanying drawings in which.

DESCRIPTION OF THE PREFERRED EMBODIMENT

Figure 1:
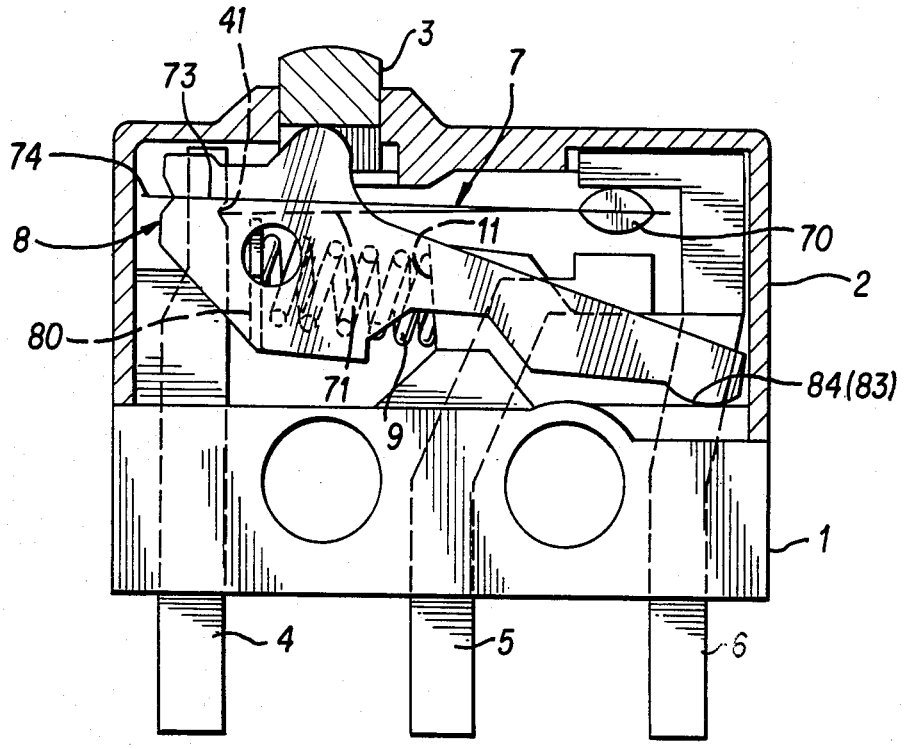
FIG. 1 shows, in elevation, the constructional arrangement of the assembly of the microswitch mechanism of the invention, the front part of the protecting cover covering the mechanism mounted on its insulating base being assumed removed.

The microswitch shown in FIG. 1 comprises, in a way known per se, a mechanism enclosed in an insulating enclosure formed of a base 1 and a cover 2 covering the whole of the mechanism. Actuation of the mechanism is made possible by the application of a force exerted on button 3 guided through the upper wall of cover 2. In the insulating mass of base 1 there is held, by molding an appropriate plastic material, the median part of three coplanar conducting shanks 4, 5, 6 having ends which emerge from base 1 inside the enclosure. The conducting shanks 4, 5 and 6 are shaped so as to form, respectively, a pivoting support and the opposite stops of the fixed contacts on which movable contacts 70, provided on switching blade 7 comes to bear. The switching blade 7 is of a generally flat and elongate shape, and is formed from a thin blade whose composite functional structure is provided by stamping out a single piece from a laminated copper alloy strip having appropriate electric and mechanical qualities. By way of example, the commercial alloy known under the trademark BERYLCO 10 is particularly suitable because of its excellent electric conductivity as well as its ability to withstand prolonged mechanical and thermal stresses. As can be seen in perspective in FIG. 2, stamping of blade 7 is carried out so as to define longitudinally a relatively wide and rigid axial arm 71 as well as a pair of relatively narrow and flexible lateral and parallel arms 72 and 73 whose front ends are connected to the end of the axial arm 71 which carries the movable contacts 70 and whose rear ends are coupled to a bridge 74 beyond the end of arm 71 which is opposite contacts 70 and which is pivotably mounted in a rectilinear notch 41, formed to have a V-shaped cross section in the front side of the conducting shank 4. That is, the end of axial arm 71 is pivotably mounted in notch 41 in shank 4. Bridge 74 is engaged with opposite facing notches on heel 81 of lever 8. The transverse bridge 74 coupled through the pair of flexible arms 72 and 73 to the free end of the pivoting arm 71 thus plays the role of an oscillating stirrup able to be moved in a plane movable angularly on each side of the pivot line of the rigid arm 71 in notch 41. To produce this movement, the transverse bridge 74 of the stirrup is engaged in a pair of V-shaped notches, of an opposite direction to notch 41 and formed in the vicinity and opposite notch 41 on the end of the heel 8′ of oscillating control lever 8.

Lever 8 is preferably made from steel plate pressed out as a single piece and formed of two side flanges 81 and 82 extending parallel in the opposite direction to the heel 8′ so as to form two legs, the ends of each of which terminate in rounded feet 83, 84 intended to bear on the upper surface of base 1, while being free to slide over this surface.

The two lateral flanges 81, 82 of lever 8 are rigidly coupled together by the cross piece 80 which has a right angle cross-section so that one of its branches is normal to the longitudinal axis of lever 8.

Thus, cross piece 80 has a surface which is substantially parallel to and situated opposite the front face 11 forming a bearing surface of a boss relief or projection molded on the median part of the upper surface of base 1.

This arrangement defines inside and along the longitudinal axis of lever 8 a housing for receiving the compression spring 9, which is preferably helical and has one end which comes to bear on the front face 11 of the boss in relief on base 1 and another and which bears on the branch of cross piece 80 which is opposite thereto in lever 8.

Figure 2:
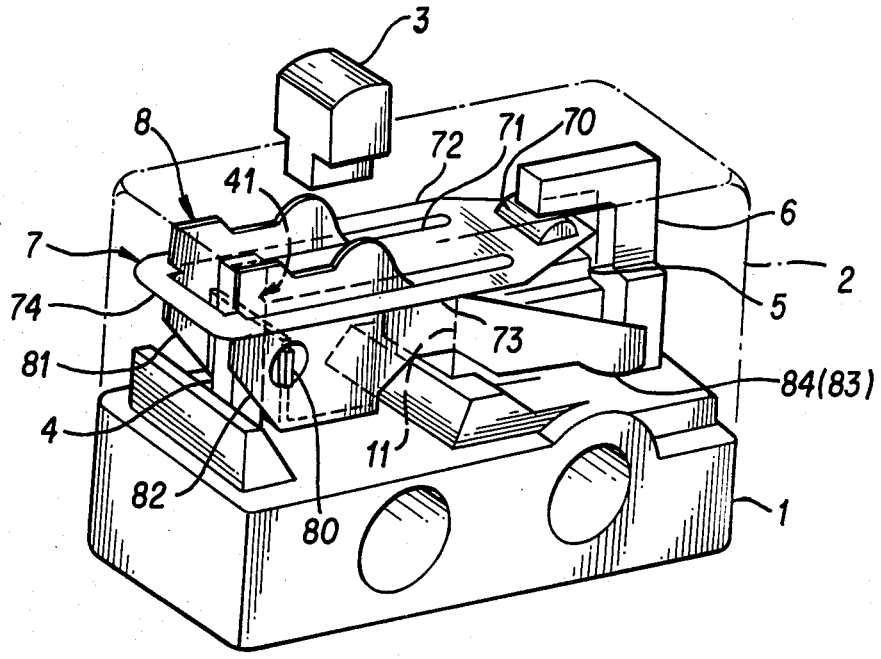
FIG. 2 shows schematically and in a partial perspective view the structure and arrangement of certain constructional elements of the microswitch of FIG. 1.
Figure 4:
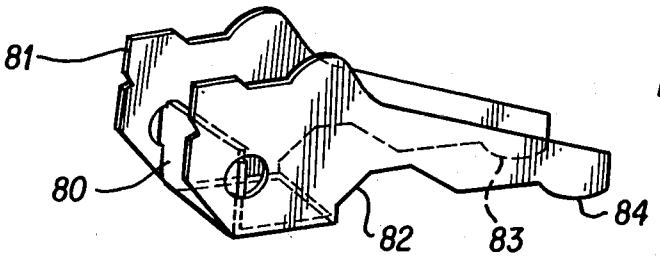
FIG. 4 is a perspective view of the structure and arrangement of the oscillating control lever.

In summary, it is seen that the heel 8′ of oscillating control lever 8 is the rear end of flanges 81 and 82 and contains notches which receive transverse bridge 74 of blade 7. Lever 8 contains two lateral flanges 81, 82 which are rigidly coupled together by crosspiece 80 which is formed of two branches and which has a right angle-shaped cross section. One branch of crosspiece 80 is perpendicular to the longitudinal axis of lever 8 and the other branch is parallel thereto, as shown in FIGS. 1 and 2. Regarding the relationship between the heel of lever 8 and crosspiece 80, it is noted that these elements are, in fact, separate elements and only the crosspiece 80 bridges lateral flanges 81, 82. The heel of lever 8 is positioned at the end of lever 8, whereas crosspiece 80 is positioned in an intermediate region of lever 8, as shown in FIGS. 1 and 2. Transverse bridge 74 constitutes part of switching blade 7 and connects the ends of lateral arms 72 and 73. Bridge 74 is supported in notches formed in the heel of lever 8, as best shown in FIG. 1.

Figure 3:
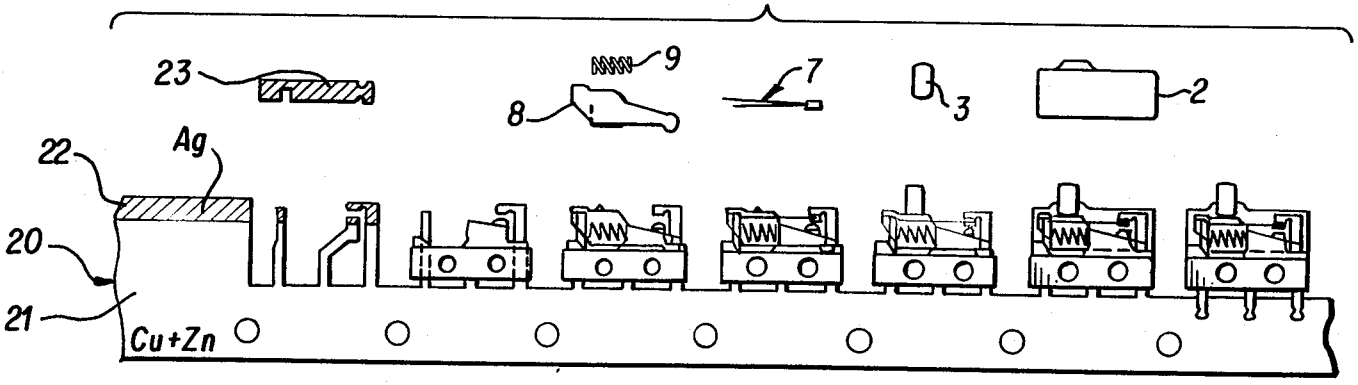
FIG. 3 shows, in a schematical process, the different steps for manufacturing the microswitch of FIGS. 1 and 2, formed in accordance with and among the objects of the invention by molding a plastic material over the insulating base supporting the mechanism on a continuous bimetallic strip.

For constructing the microswitch of the invention, the following is the procedure, with reference to FIG. 3. Starting with a continuous bimetallic strip 20 formed with two portions 21, 22, a first portion 21, made from Cu and Zn and a second portion 22 made from Ag, the three conducting shanks 4, 5, 6 are first of all stamped, with the removed silver strip (Ag) 23 being recovered. Then, the insulating base 1 is formed by molding over the shanks 4, 5 and 6 with plastic material. Then, the lever 8, spring 9, blade 7, button 3 and cover 2 are fitted to form a completed assembly. Then, each switch device is separated from the rest. It only remains then to finally separate the device from strip 20. The construction of the device of the invention is then provided by progressive stamping which, in addition to the accuracy of manufacture, allows the superfluous part of precious metal (Ag) to be recovered which covers the contact zones of the terminals which themselves are made from an ordinary metal (Cu, Zn).

While a preferred embodiment of the invention has been described, it should be apparent that many modifications can be made without departing from the spirit and scope of the invention. Accordingly, the invention is not to be considered as limited by the foregoing description, but is only limited by the scope of the claims appended hereto.

What is claimed is:

1. An electromechanical switching device, comprising:

an insulating base having a support surface and a projection forming a bearing surface;

a compression spring having a thrust axis, a first end of said compression spring engaging with said bearing surface, the thrust axis of said spring being disposed substantially parallel to said support surface of said base;

at least first, second and third coplanar conducting terminals projecting from said base, said first terminal being electrically connected to a movable conducting contactor, said movable contactor being movable to different positions whereby it respectively electrically connects with said second and said third terminals;

an oscillating lever for causing movement of said movable contactor, said lever having at one end a first portion thereof in which said compression spring is mounted, and at another end a second portion defining a pair of feet which slidingly bear on said support surface, said first portion including a surface against which a second end of said compression spring resiliently bears;

said movable contactor comprising a substantially flat conducting blade formed as a single piece and including a rigid axial arm pivotably mounted at a pivot point to said first terminal, and two flexible lateral arms fixed to a free end of said rigid axial arm and interconnected to form a stirrup at ends of said lateral arms which are positioned in a longitudinal direction of said blade beyond said pivot point; and an actuator mechanism for providing an operating force to said oscillating lever, which in turn supplies said operating force to said stirrup to cause flexure of said lateral arms and movement of said movable contactor.

* * * * *